United States Patent [19]

Childs et al.

[11] Patent Number: 4,969,672

[45] Date of Patent: Nov. 13, 1990

[54] DECK LID RELEASE ACTUATOR

[75] Inventors: Shane Childs, Sterling Hts.; David E. Compeau, Mt. Clemens; Lloyd W. Rogers, Jr., Utica, all of Mich.

[73] Assignee: General Motors Corporation, Detroit, Mich.

[21] Appl. No.: 352,808

[22] Filed: May 15, 1989

[51] Int. Cl.[5] ..... E05C 3/26

[52] U.S. Cl. ..... 292/201; 292/216

[58] Field of Search ..... 292/142, 144, 172, 201, 292/336.3, 341.16

[56] References Cited

U.S. PATENT DOCUMENTS

| | | | |
|---|---|---|---|
| 2,785,916 | 3/1957 | Mutti | 292/144 |
| 3,655,240 | 4/1972 | DuRocher et al. | 292/201 X |
| 4,674,781 | 6/1987 | Reece et al. | 292/201 X |
| 4,723,454 | 2/1988 | Periou et al. | 292/201 X |
| 4,848,810 | 7/1989 | Gosse et al. | 292/201 X |
| 4,893,704 | 1/1990 | Fry et al. | 292/201 X |

*Primary Examiner*—Richard E. Moore

*Attorney, Agent, or Firm*—Charles E. Leahy

[57] ABSTRACT

A deck lid release actuator in which a uni-directional motor is mounted on a housing and rotatably drives a screw having high lead threads. The screw is rotatably journaled in a housing and a saddle nut threadedly engages the high lead threads of the screw so that rotation of the screw drives the saddle nut along the screw. An actuator member operably engages the detent lever of the deck lid latch and is mounted on the housing by a slide track extending parallel with the screw. When energization of the motor turns the screw, the saddle nut abuts against the actuator member to move the actuator member along the slide track and unlatch the deck lid latch. A spring acts on the actuator member to return the actuator member along the slide track thereby pushing the saddle nut axially along the screw as permitted by rotary back-drive of the screw and motor by the effort of the spring. The slide track mounting of the actuator member on the housing independently of the saddle nut serves to restrain the actuator member against rotation so that torque applied on the actuator member by the latch is isolated from the saddle nut and screw.

6 Claims, 2 Drawing Sheets

DECK LID RELEASE ACTUATOR

The invention relates to a automobile deck lid latch and more particularly to a motor driven actuator for releasing the latch to allow the deck lid to spring to an open position.

BACKGROUND OF THE INVENTION

It is well known in more vehicles to provide a deck lid panel for closing a luggage compartment. The deck lid panel is mounted on the vehicle body by hinges. A spring is associated with the hinges to lift the deck lid panel to an open position.

A deck lid latch is conventionally provided to engage with a striker for latching the deck lid in the closed position. The deck lid latch conventionally includes a fork bolt engageable with the striker and a detent lever for latching the fork bolt at a latched position with respect to the striker to capture the striker within the latch and thereby to latch the deck lid panel in the closed position.

It is well known in the prior art to release the deck lid latch by pivoting the detent lever to an unlatched position with respect to the fork bolt. The detent lever may be pivoted by a key operated lock cylinder. It is also known to remotely actuate the deck lid latch by mounting an electrical solenoid on the latch with the solenoid connected with the detent lever so that energization of the solenoid pivots the detent lever to the unlatching position.

It would be desirable to provide a new and improved electrically operable release actuator for releasing a deck lid latch.

Summary of the Invention

The invention relates to a new and improved deck lid release actuator in which a uni-directional motor is mounted on a housing and rotatably drives a screw having high lead threads. The screw is rotatably journaled in a housing and a saddle nut threadedly engages the high lead threads of the screw so that rotation of the screw drives the saddle nut along the screw. An actuator member operably engages the detent lever of the deck lid latch and is mounted on the housing by a slide track extending parallel with the screw. When energization of the motor turns the screw, the saddle nut abuts against the actuator member to move the actuator member along the slide track and unlatch the deck lid latch. A spring acts on the actuator member to return the actuator member along the slide track thereby pushing the saddle nut axially along the screw as permitted by rotary back-drive of the screw and motor by the effort of the spring. The slide track mounting of the actuator member on the housing independently of the saddle nut serves to restrain the actuator member against rotation so that torque applied on the actuator member by the latch is isolated from the saddle nut and screw.

Accordingly one object, feature and advantage of the invention resides in the provision of an actuator member in which a motor is energized to rotate a screw in one direction to move an actuator member and a spring acting on the actuator member moves the actuator member in the other direction along the screw as permitted by rotary backdrive of the screw and the motor.

A further object, feature and advantage of the invention resides in the provision of an axial slide track mounting an actuator member on a housing to restrain the actuator member against rotation so that torque applied on the actuator member by the associated latch mechanism is isolated from a motor driven screw and nut device operating the actuator member.

These and other feature, objects and advantages of the invention will become apparent upon consideration of the description of the preferred embodiment and the appended drawings in which:

Description of the Preferred Embodiment

Figure 1:
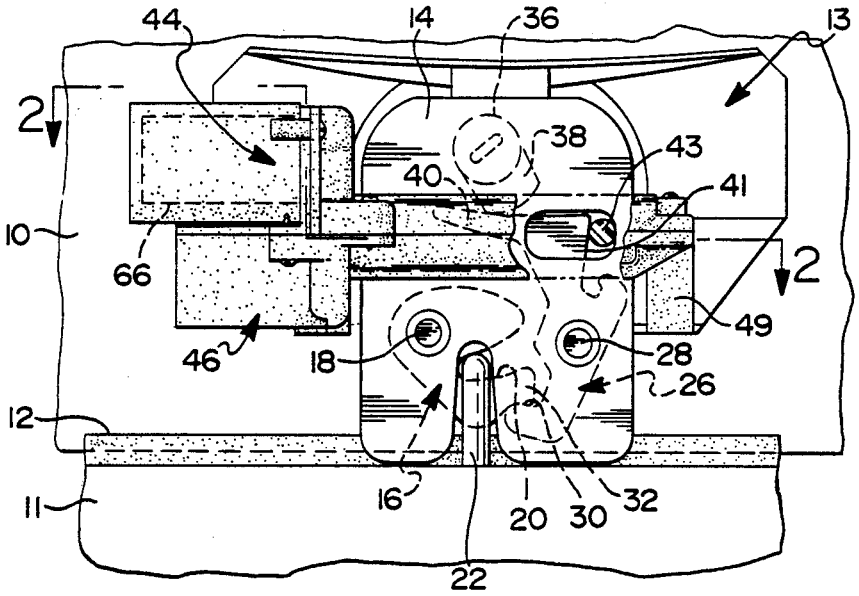
FIG. 1 is an elevation view of a deck lid latch having the release actuator of the present invention.

Referring to FIG. 1 a deck lid closure panel of a vehicle body is indicated at 10. The closure panel 10 is hingedly mounted on the vehicle body for movement between open and closed positions with respect to a vehicle compartment. The closure panel 10 is spring loaded for movement to an open position with respect to the compartment.

FIG. 1 also shows a body panel 11 which defines the compartment opening 12 selectively opened and closed by the closure panel 10.

The closure panel 10 may be latched in the closed position by a latch assembly generally indicated at 13. The latch assembly 13 includes a housing 14 having a latch bolt 16 mounted thereon by pivot 18. The latch bolt 16 has an opening 20 by which the latch bolt 16 is engageable with a striker rod 22 carried by the body panel 11 to latch and interconnect the closure panel 10 with the body panel 11. The latch assembly 13 includes a spring, not shown which biases the latch bolt to an unlatched position in the clockwise direction from the latched position shown in FIG. 1.

As shown in FIG. 1 the latch assembly 13 includes a detent lever 26 mounted on the housing 14 by pivot 28 and having a hook 30 which engages with a hook 32 of the latch bolt 16 to hold the latch bolt 16 in the latched position with respect to the striker 22 as shown in FIG. 1. A spring, not shown, urges the detent lever 26 to the latched position of FIG. 1.

The latch assembly 13 also includes a key operated lock cylinder 36 which is rotatable when a properly fitted key is inserted. The key cylinder carries a cam 38 which, upon rotation of the key cylinder 36, engages a cam follower portion 40 of the detent lever 26 to pivot the detent lever 26 about its pivot 28 and thereby disengage the detent lever hook 30 from the latch bolt hook 32 so that the spring returns the latch bolt 16 to its unlatched position. Accordingly, the latch bolt 16 is freed from engagement with the striker rod 22 enabling the closure panel 10 to be moved to its open position by the closure panel spring.

Figure 2:
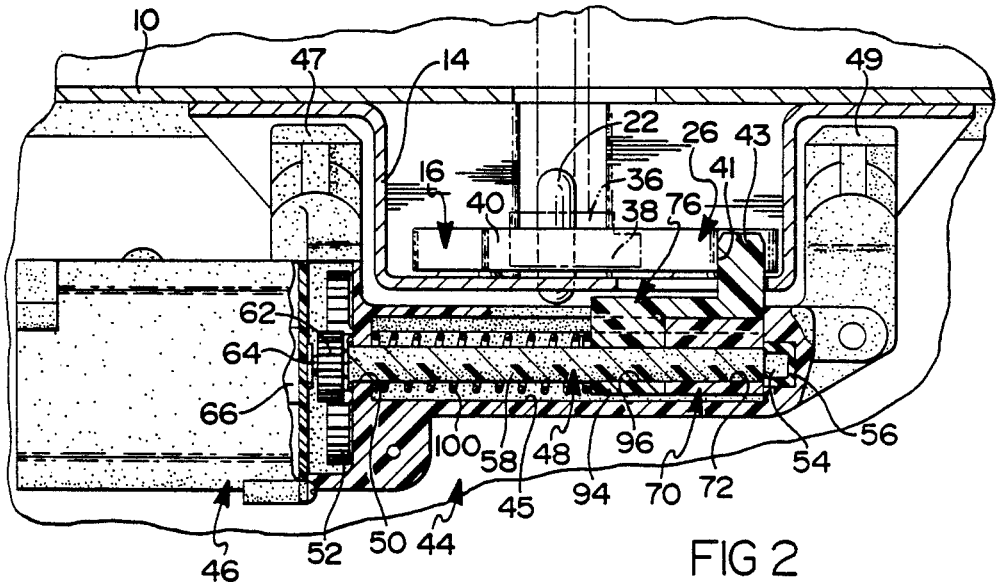
FIG. 2 is a section view taken in the direction of arrow 2—2 of FIG. 1.

FIG. 1 also shows a release actuator generally indicated at 44 which is operable to unlatch the latch assembly 13 by pivoting the detent lever 26. The release actuator 44 is comprised of a multi-piece plastic housing 46 and includes an actuator arm 43 which engages with an abutment face 41 of the detent lever 26. The release actuator 44 operates the actuating arm 48 as will be described hereinafter. As best seen in FIG. 2 the plastic housing 46 includes integrally molded plastic feet 47 and 49 which are adapted to be attached to the latch 13 by screws or other suitable fastening devices.

Figure 4:
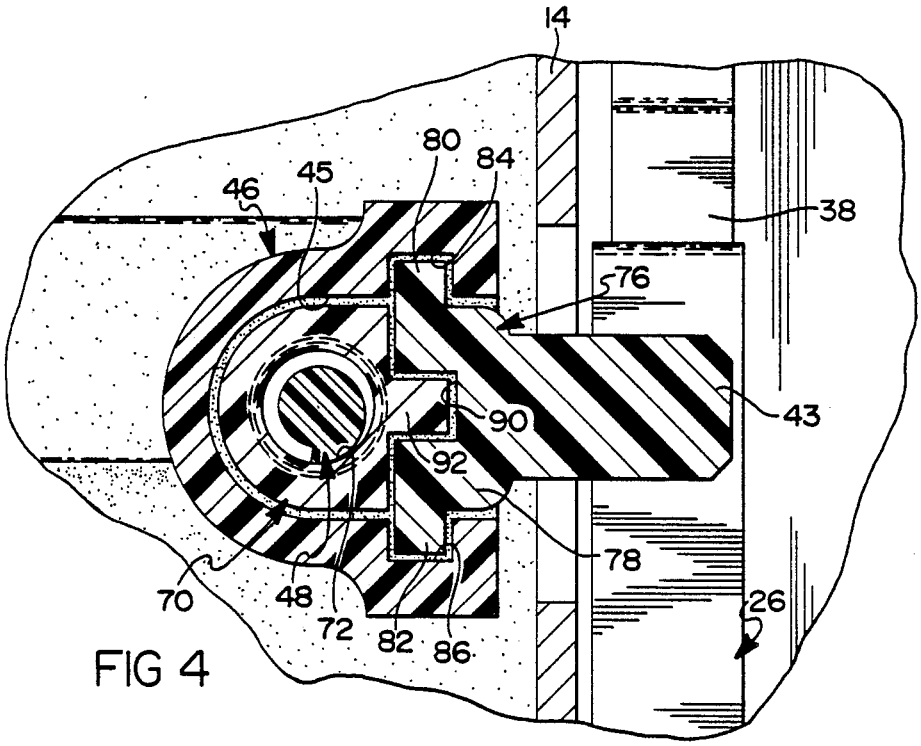
FIG. 4 is an enlarged sectional view taken in the direction of arrows 4—4 of FIG. 3.

Referring to FIGS. 2 and 4, it is seen that the molded plastic housing 46 of the actuator assembly 44 has a generally U-shaped configuration with an open channel 45 defined together and extending longitudinally of the housing. A molded plastic high lead screw 48 is mounted in the channel 45. The one end of high lead screw 48 seats in a bearing 50 and carries a spur gear 52 formed integrally therewith. The opposite end 54 of the high lead screw 48 seats in a bearing 56 mounted in the housing 46. The high lead screw 48 has a high lead screw thread 58 disposed along the length thereof.

A molded plastic spur gear 62 meshes with the spur gear 52 and is mounted on a shaft 64 which extends from a motor 66 carried by the plastic housing 46. Energization of the motor rotates the spur gear 62 which in turn rotates the spur gear 52 and the high lead screw 48.

A molded plastic saddle nut 70 encircles the high lead screw 48 and has internal screw teeth 72 which mesh with the high lead thread 58 of the screw 48. As best seen in FIG. 4, the saddle nut 70 is non-circular in cross-section and fits closely within the walls of the channel 45 or plastic housing 46 so that the saddle nut 70 is prevented from rotating within the plastic housing 46. Because the saddle nut 70 is restrained against rotation within the housing, rotation of the screw 58 by motor 66 will move the saddle nut 70 axially within the housing and forced axial movement of the saddle nut 70 within the housing will forcibly rotate the screw 58.

A molded plastic actuator member 76 acts between the saddle nut 70 and the detent lever 26 of the latch assembly 13. As best seen in FIG. 4, the actuator member 76 includes a base 78 which it is slidably mounted on the housing 46 by lateral extending legs 80 and 82 which are slidably captured in slide tracks 84 and 86 formed integrally in the housing 46. The actuator arm 43 extends from the base 78 of the actuator member 76 and engages with the adjustment face 41 of the detent lever 26. In addition, the base 78 of the actuator member 76 has a groove 90 in the base thereof which faces toward the saddle nut 70 and slidably receives a tongue 92 formed integrally with the saddle nut 70 to restrain the saddle nut 70 against rotation within the housing 46.

As best seen in FIG. 2, the actuator member 76 also includes an integral abutment tail portion 94 having a bore 96 which encircles the screw 48. The bore 96 carries no teeth so that the actuator member 76 is permitted to move axially along the plastic housing 46 independently of the saddle nut 70 and screw 48. This independent axial sliding movement of the actuator member 76 is controlled, guided and limited by the sliding engagement of legs 80 and 82 of the actuator member 76 within the guide tracks 84 and 86 of the housing 46.

As been seen in FIG. 2, a coil compression spring 100 encircles the screw 48 and acts between the housing 46 and the abutment tail 94 of the actuator member 76 to urge the actuator member 76 to the rightward position shown in FIGS. 1 and 2 in which the detent member 26 is permitted to attain the latched position of FIG. 1. The spring 100 maintains the actuator member 76 at the position of FIG. 2 so that the detent lever 26 is free for operation by the key cylinder 36.

Operation

In order to remotely release the deck lid latch 13, the vehicle operator operates a push button, preferably mounted in the occupant compartment, to energize the electric motor 66. The motor 66 is a uni-directional motor and rotates the screw 48 via the gear reduction set provided by spur gears 62 and 52. Rotation of the screw 48 by the motor 66 causes high lead threads 58 of the screw 48 meshing with the threads 72 of the saddle nut 70 to pull the saddle nut 70 leftwardly from the position of FIG. 2 to the position of FIG. 3. This leftward movement of the saddle nut 70, which engages with the abutment tail portion 94 of the actuator member 76, also moves the actuator member 76 leftwardly so that the actuator arm 43 pivots the detent lever 26 of the latch assembly 13 to an unlatched position with respect to the fork bolt 16. Accordingly the fork bolt 16 is freed for spring biased movement to an unlatched position with respect to the striker 22 so that the deck lid panel 10 is unlatched for opening movement.

Figure 3:
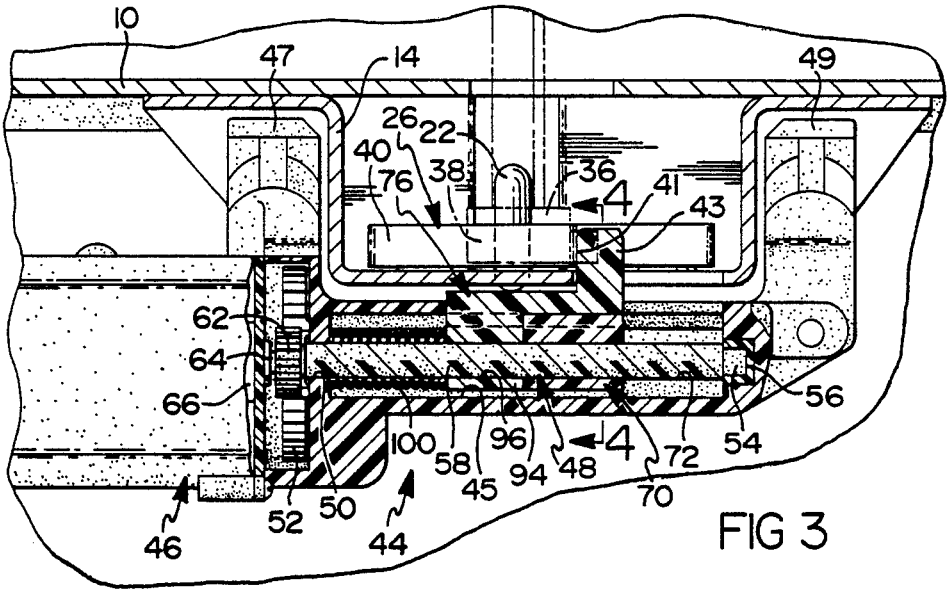
FIG. 3 is a view similar to FIG. 2 but showing the motor having rotated the high lead screw to move the saddle nut and actuator member in the direction to release the deck lid latch.

When the motor 66 is deenergized, the coil compression spring 100 is permitted to return the actuator member 76 rightwardly from the position of FIG. 3 to the position of FIG. 2. The rightward movement of the actuator member 76 pushes the saddle nut 70 rightwardly which in turn forcibly rotates the screw 48 and backdrives the motor 66 through the spur gears 52 and 62.

It will appreciated that the operation of the detent lever 26 by the actuator member 76 upon motor driven leftward movement of the saddle nut 70 will cause the actuator member 76 to be subjected to substantial eccentric torque loads which would cause pitching, rolling, yawing or other movement of the actuator member 76. These loads applied to the actuator member 76 are effectively isolated from the saddle nut 70 and the screw 48 by virtue of the actuator member 76 being independently mounted on the housing 46 by its legs 80 and 82 riding in the slide tracks 84 and 86 of the plastic housing 46.

Thus it is seen that the invention provides a new and improved deck lid release actuator which is economical of manufacture and also constructed for reliable operation in the adverse operating environment of a deck lid closure latch.

Although the actuator of this invention is disclosed herein used for releasing a deck lid latch, it will be appreciated that the actuator may have other uses in automotive vehicles such as actuating or releasing other mechanisms in the vehicle body.

The embodiments of the invention in which an exclusive property or privilege is claimed are defined as follows:

1. An actuator for the remote release of a latch in a motor vehicle a housing;

an actuator member operably associated with the latch;

a screw having high lead threads operatively engaging the actuator member;

a motor mounted on the housing and connected to the screw to rotate the screw in one direction to move the actuator member along the screw in one direction to release the latch;

and spring means acting on the actuator member to return the actuator member in the other direction along the screw and thereby rotate the screw in the other direction and backdrive the motor.

2. The actuator of claim 1 further characterized by the operative engaging between the threads of the screw and the actuator member being provided by a saddle nut threadedly engaged on the threads of the screw and abutting against the actuator member to move the actuator member upon movement of the saddle nut, and said actuator member being mounted on the housing by an axial slide track effective to restrain the movement of the actuator member so that torque applied on the actuator member by the latch is isolated from the saddle nut and screw.

3. An actuator for the remote release of a latch in a motor vehicle, comprising:

a housing;

a screw rotatably mounted in the housing and having high lead threads;

a nut threadedly engaged on the screw;

means preventing rotation of the nut with respect to the housing so that rotation of the screw moves the nut axially along the screw and axial movement of the nut along the screw rotates the screw;

an actuator member operably associated with the latch and with the nut so that axial movement of the nut along the screw in one direction moves the actuator member in one direction to release the latch;

a motor mounted on the housing and connected to the screw to rotate the screw in one direction to move the actuator member along the screw in the one direction to release the latch;

and spring means acting on the actuator member to move the actuator member and the nut in the other direction along the screw and thereby rotate the screw in the other direction and backdrive the motor.

4. An actuator for the remote release of a latch in a motor vehicle, comprising:

a housing;

a screw rotatably mounted in the housing and having high lead threads;

a saddle nut threadedly engaged on the screw;

means preventing rotation of the saddle ntu with respect to the housing so that rotation of the screw moves the saddle nut axially along the screw and axial movement of the saddle nut along the screw rotates the screw;

an actuator member engaging the latch and being free of direct driving engagement with the screw to permit axial movement of actuator member independent of the screw;

mounting means mounting the actuator member on the housing for axial sliding and limited rotational movement in a path parallel to the path of axial movement of the saddle nut;

and a motor mounted on the housing and connected to the screw to rotate the screw in one direction to move the saddle nut along the screw and into drive engagement with the actuator member and thereby drive the actuator member to release the latch.

5. An actuator for the remote release of a latch in a motor vehicle, comprising:

a housing;

a screw rotatably mounted in the housing and having high lead threads;

a saddle nut threadedly engaged on the screw;

means preventing rotation of the saddle nut with respect to the housing so that rotation of the screw moves the saddle nut axially along the screw and axial movement of the saddle nut along the screw rotates the screw;

an actuator member engaging the latch;

mounting means mounting the actuator member on the housing for axial sliding and limited rotational movement in a path parallel to the path of axial movement of the saddle nut;

a motor mounted on the housing and connected to the screw to rotate the screw in one direction to move the saddle nut along the screw and into driving engagement with the actuator member and drive the actuator member to release the latch;

and spring means acting on the actuator member to move the actuator member and the nut in the other direction along the screw and thereby rotate the screw in the other direction and backdrive the motor.

6. An actuator for the remote release of a latch in a motor vehicle, comprising:

a housing having a longitudinal extending channel;

a screw rotatably mounted on the housing in the channel and having high lead threads;

a saddle nut threadedly engaged on the screw;

means preventing rotation of the saddle nut with respect to the actuator arm so that rotation of the screw moves the saddle nut axially along the screw and axial movement of the saddle nut along the screw rotates the screw;

an actuator member having an arm engaging the latch and legs projecting laterally from each side of the actuator member;

first and second slide tracks formed integrally in the housing on each side of the channel and receiving the legs of the actuator member to mount the actuator member on the housing for axial sliding and non-rotational movement in a path parallel to the path of axial movement of the saddle nut along the screw;

a motor mounted on the housing and connected to the screw to rotate the screw in one direction to move the saddle nut along the screw and into driving engagement with the actuator member and drive the actuator member to release the latch;

and spring means acting on the actuator member to move the actuator member and the nut in the other direction along the screw and thereby rotate the screw in the other direction and backdrive the motor.

* * * * *